US005441572A

United States Patent [19]

Rodzewich

[11] Patent Number: 5,441,572

[45] Date of Patent: Aug. 15, 1995

[54] AMBIENT CLEANERS FOR ALUMINUM

[75] Inventor: Edward A. Rodzewich, Flourtown, Pa.

[73] Assignee: Betz Laboratories, Inc., Trevose, Pa.

[21] Appl. No.: 155,398

[22] Filed: Nov. 19, 1993

[51] Int. Cl.[6] ..... B08B 3/08; C23G 1/14

[52] U.S. Cl. ..... 134/2; 134/3; 134/28; 134/29; 134/40; 134/41

[58] Field of Search ..... 134/2, 40, 29, 41, 28, 134/3; 252/79.5, 81, 135, 156, 541, 546

[56] References Cited

U.S. PATENT DOCUMENTS

| | | | |
|---|---|---|---|
| 4,028,205 | 6/1977 | Dorsey, Jr. | 204/181 |
| 4,859,351 | 8/1989 | Awad | 252/32.5 |
| 5,061,389 | 10/1991 | Reichgott | 252/49.3 |
| 5,110,494 | 5/1992 | Beck | 252/156 |
| 5,232,514 | 8/1993 | Van Sciver et al. | 134/26 |

OTHER PUBLICATIONS

Exxon Chemical Company Performance Products Group, P-15, Mar. 8, 1990.

*Primary Examiner*—David A. Simmons
*Assistant Examiner*—Zeinab El-Arini
*Attorney, Agent, or Firm*—Alexander D. Ricci; Richard A. Paikoff

[57] ABSTRACT

A method and composition for cleaning aluminum surfaces is disclosed. The surfaces are contacted with a treatment comprising potassium hydroxide, a silicate compound and an alkyl imino acid surfactant.

10 Claims, No Drawings

AMBIENT CLEANERS FOR ALUMINUM

FIELD OF THE INVENTION

The present invention relates to a non-etching cleaner for aluminum that has excellent cleaning efficacy at ambient conditions, is phosphate free and will not build up oxide or stain aluminum surfaces.

BACKGROUND OF THE INVENTION

Single stage cleaning of metal surfaces with aqueous cleaning solutions is known. The cleaning solutions remove coolants and lubricants employed in machining operations. Metal fines and other contaminants from metal forming and machining operations are also removed by the cleaning process. Conventional cleaners frequently result in a surface finish which is susceptible to oxidation. For metal articles which are machined to close tolerances, such surface degradation can have a deleterious effect on later operations, such as automated assembly operations.

Typically, aluminum parts undergo a series of machining, polishing, stamping, etc., steps prior to being considered a finished part. After each step, the processing soils must be removed so that the parts can be tested and inspected prior to subsequent operations. The cleaners which are used to remove these soils must not stain, etch or discolor the metal. In addition, other requirements may exist, which are specific to a particular operation.

For aluminum cleaning, it is important that the cleaner not stain or darken the surface. Aside from the darkening being aesthetically unpleasing, it is an indication of the surface being attacked or dissolved and oxide formation occurring. Many aluminum parts being cleaned are highly polished, and any appearance of an oxide or darkening is a source for rejection. Many cleaners in current use for cleaning aluminum contain alkanolamines or phosphates. These substances tend to leave a stain or haze on the aluminum part, or etch the surface.

The requirements of a single stage cleaning process are substantially different than other metal cleaning operations. Only a single pH may be used. Intermediate rinses are not available to remove soils and metallic fines. The cleaning solution must drain efficiently from the cleaned surface. Also, the growth of oxide layers on the metal surface must be controlled after oils have been removed by the cleaner. The current use of chlorinated solvents to accomplish these goals is under increasing pressure from both health and environmental regulations.

SUMMARY OF THE INVENTION

The present invention provides an additive for a single stage aqueous in-process cleaning composition for aluminum surfaces. The additive is particularly suitable when there is no requirement for lubricity or steel passivation in the system, and is useful in preventing oxide buildup on the part. This cleaner will not foam at ambient temperature, and will not stain or etch aluminum surfaces.

The additive of the present invention comprises potassium hydroxide, a silicate compound and an alkyl imino acid. Therefore, it is possible to formulate a product that is free from phosphates, amines and alkanolamines. The composition contains no glycol ethers, phosphates, amines or other organic sequestrants. The additive is easily waste treatable, and its surfactants are biodegradable. Furthermore, the treatment requires no heat in order to be effective.

DETAILED DESCRIPTION OF THE INVENTION

The combination of potassium hydroxide, a silicate compound and an alkyl imino acid surfactant was found to impart enhanced cleaning efficiency for aluminum parts. All components are commercially available. The alkyl imino acid is commercially available from the Exxon Corporation as Amphoteric 400, an iminodipropionate surfactant. The present invention is especially effective at ambient temperatures of about 60°–130° F., and a pH range of from about 10–13.

The treatment is prepared for use by blending its components together in an aqueous medium, such as deionized water, to form a concentrate. The treatment is equally effective in hard waters, deionized and softened water. The treatment is dissolved within the aqueous medium in a concentration of from about 1.75% v/v to about 10% v/v.

The parts being tested were spray cleaned. It is expected that the treatment will provide comparable performance in immersion applications.

A preferred formulation would contain potassium hydroxide, an alkali metal silicate, an alkyl imino acid, monosodium salt and an alkali metal (e.g., sodium) sulfonate. A particularly preferred formulation (experimental formulation) contains the following components:

| | Weight Percentages (Approximate) |
|---|---|
| Potassium Hydroxide Solution, 45% | 5% |
| Sodium Silicate | 10% |
| Amphoteric 400 | 6% |
| Witconate SXS, 40% (linear alkyl-aryl sodium sulfonate from Witco Chemical) | 4% |
| Water | Remainder |

Concentration limits of specific ingredients

The low concentration limit is the amount needed to produce a surface having about 95+% water break free condition, determined to be about 1.75% by volume. Based on a specific gravity of 1.073, this amounts to about 1.88 wt/v. The low concentration limits of specific ingredients are:

| Components | % |
|---|---|
| Potassium hydroxide solution, 45% | 0.09 |
| Sodium silicate | 0.19 |
| Amphoteric 400 | 0.11 |
| Witconate SXS, 40% | 0.08 |
| Water | 1.41 |
| | 1.88 |

The high limit of 10% v/v amounts to a quantity of cleaner at 10% v/v of 10.73 wt/v. Specific ingredients:

| Components | % |
|---|---|
| Potassium hydroxide solution, 45% | 0.54 |
| Sodium silicate | 1.07 |
| Amphoteric 400 | 0.64 |
| Witconate SXS, 40% | 0.43 |

-continued

| Components | % |
|---|---|
| Water | 8.05 |
| | 10.73 |

The present invention will be further illustrated, but is not limited by, the following examples.

Aluminum panels (3003, 2036, 3004 type) were sprayed with a 2% solution of the experimental formulation contaminated with 1% of Cimperial 1010 coolant (proprietary product of Cincinnati Milacron), using a conventional laboratory spray cabinet, in order to simulate an aged bath condition. The temperature was maintained between 60°–70° F., with a cleaning time of 60 seconds. Under the conditions of this test, all of the panels exhibited 100% water break-free (WBF) surfaces, as shown in Table 1, below. A minimum concentration of 1.75% of the formulation was needed to produce 95% plus water break-free conditions. Cleaning efficacy drops off quickly below this concentration. Note that 100% water break-free surface conditions resulting in 60 seconds spray time is considered to be very good cleaning efficacy.

TABLE 1

Cleaning Performance on Aluminum Panels

| | % Dose on Panel | | |
|---|---|---|---|
| % WBF | 3003 | 3004 | 2036 |
| 50–55 | 0.5 | 1.0 | 0.5 |
| 70–75 | 1.0 | 1.2 | 1.0 |
| 80–85 | 1.5 | 1.7 | 1.7 |
| 95–97 | 1.7 | 1.9 | 1.9 |
| 99–100 | 2.0 | 2.0 | 2.0 |

In an additional experiment, a freshly lathed disc of 380 aluminum alloy was partially submerged for one week while maintaining initial fluid volume in an 80 mm petri dish, approximately ⅔ full with a 5% solution of the experimental formulation. The possible degrees of attack on the disc are as follows:

Slight—light discoloration, almost the same as the original disc.

Medium—gray

Heavy—dark gray, black.

Under the above-identified conditions, the experimental formulation produced no visible change to the polished aluminum surface. A commercial cleaner, Producto SP 104 (a monoethanol-amine based product of Producto Chemicals, Inc.) turned the part uniformly black.

Further testing of the efficacy of the present invention involved an experiment to determine the degree of oxide buildup on aluminum parts. Parts were immersed in the experimental formulation at working temperature (70° F.) and concentration (2% by volume) for about 3 hours. Acceptable results called for a weight change not exceeding plus or minus 0.05%, with no discoloration or staining of parts.

No weight loss or gain was observed using 3003 alloy aluminum when tested according to this method. The cleaner was used at 2% by volume at ambient temperature.

A variation of the immediately preceding test calls for the evaluation of a freshly lathed 380 aluminum alloy and its immersion in a 5% solution of the experimental formulation for one week at a temperature of about 100° C., and measuring the corrosion weight loss. In this test, the experimental formulation exhibited a weight loss of about 9.5 mg/ft$^2$. In contrast, Producto SP 104 exhibited a weight loss of 317 mg/ft$^2$.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

I claim:

1. A method for preventing oxide buildup on an aluminum surface at ambient temperature which comprises contacting the aluminum surface with a treatment comprising potassium hydroxide, a silicate compound and an iminodipropionate amphoteric surfactant, wherein the surface is contacted with the treatment at a pH of from about 10–13, said treatment dissolved in an aqueous medium in a concentration of from about 1.75% to about 10% by volume.

2. The method as recited in claim 1 wherein said silicate compound is sodium silicate.

3. The method as recited in claim 1 wherein the treatment further comprises an alkali metal sulfonate.

4. The method as recited in claim 3 wherein said alkali metal sulfonate is sodium sulfonate.

5. The method as recited in claim 1 wherein the surface is contacted with the treatment at a temperature of from about 60°–130° F.

6. The method as recited in claim 1 wherein the surface is contacted with the treatment at a pH of from about 10–13.

7. The method as recited in claim 1 wherein said treatment prevents the etching of said aluminum surface.

8. The method as recited in claim 1 wherein said treatment prevents the staining of said aluminum surface.

9. The method as recited in claim 1 wherein said treatment prevents the darkening of said aluminum surface.

10. The method as recited in claim 1 wherein the cleaning is in a single stage.

* * * * *